US007445483B2

(12) United States Patent
Jee

(10) Patent No.: US 7,445,483 B2
(45) Date of Patent: Nov. 4, 2008

(54) SIGNAL CONNECTOR

(75) Inventor: Beam-Chi Jee, Tu Cheng (TW)

(73) Assignee: Hanlong Industrial Co., Ltd., Tu Cheng (TW)

( * ) Notice: Subject to any disclaimer, the term of this patent is extended or adjusted under 35 U.S.C. 154(b) by 0 days.

(21) Appl. No.: 11/739,223

(22) Filed: Apr. 24, 2007

(65) Prior Publication Data

US 2008/0139037 A1 Jun. 12, 2008

(30) Foreign Application Priority Data

Sep. 12, 2006 (TW) ..... 95133758 A

(51) Int. Cl.
*H01R 13/625* (2006.01)

(52) U.S. Cl. ..... 439/344

(58) Field of Classification Search ..... 439/344, 439/676, 941, 418

See application file for complete search history.

(56) References Cited

U.S. PATENT DOCUMENTS 6,783,402 B2 * 8/2004 Chen ..... 439/676
7,048,572 B1 * 5/2006 Ting ..... 439/418

* cited by examiner

*Primary Examiner*—Ross N Gushi
(74) *Attorney, Agent, or Firm*—Alan Kamrath; Kamrath & Associates PA

(57) ABSTRACT

A signal connector includes a first container and a second container. The first container includes a first signal line container which can contain a plurality of cores and a first fastener which can fix the signal line. The second container includes a second signal line container which can contain the plurality of cores and a plurality of electric contacts which can be electrically connected with each of the plurality of cores. The second container can be connected with the first container.

16 Claims, 7 Drawing Sheets

SIGNAL CONNECTOR

BACKGROUND OF THE INVENTION

1. Field of the Invention

The present invention relates to a connector and, more particularly, the invention relates to a signal connector which is adapted to be connected with a signal line comprising a plurality of cores.

The present invention relates to a connector and, more particularly, the invention relates to a signal connector which is applied to he connected with a signal line comprising a plurality of cores.

2. Description of the Related Art

A signal line, a network line or a telephone line, for instance, is a wire in common use. Inside each signal line comprises a plurality of cores, and each of the plurality of cores delivers a different signal. When the signal line connects with a socket, it is necessary to use a signal connector for the purpose of fixing and connecting electricity.

Please refer to FIGS. 1A, 1B. 2A and 2B which are shown as a prior signal connector 80. FIGS. 1A and 1B are shown as a state diagram for a prior signal connector 80 when the signal line 90 is not fixed, and FIGS. 2A and 2B are shown as a state diagram for the prior signal connector 80 when the signal line 90 is fixed.

Please refer to FIGS. 1A and 1B. The signal line 90 comprises a plurality of cores 91. Inside of the signal connector 80 also has a corresponding containing space to allow the cores 91 to pass through. When someone wants to fix the signal line 90 in the signal connector 80, every core 91 of the signal line 90 must be separately passed through the corresponding containing space first.

Please refer to FIGS. 2A and 2B. After every core 91 of the signal line 90 separately passes through the corresponding containing space, a hand tool is used to press down the fastener 81 and the plurality of electric contacts 82 separately. The fastener 81 fixes the signal connector 80 and the signal line 90 with each other. Each of the plurality of electric contacts 82 pricks the isolation layer of each of the plurality of cores 91 to make every plurality of electric contacts 82 electrically connected with each of the plurality of cores 91 separately. Signal from signal line 90 can be delivered by the plurality of electric contacts 82 while connected with an external socket (not shown in the figures). The fixed part 83 can be used to fix the signal connector 80 with the external socket.

However, the prior signal connector 80 has many drawbacks. Because the prior signal connector 80 is long in shape, each of the plurality of cores 91 has to pass a certain distance to reach the containing space of the cores 91. Since the cores 91 are long and thin signal lines often, the plurality of cores 91 cannot be smoothly taken into the containing space. It is quite inconvenient when using the prior signal connector.

Moreover, because the end of the containing space is in a closed state, the plurality of cores 91 have to be cut into the same length in advance. Otherwise, a certain longer core 91 may wedge against the end of the containing space, so it is not possible to put all of the plurality of cores 91 into the containing space.

Therefore, it is desirable to provide a signal connector to mitigate and/or obviate the aforementioned problems.

SUMMARY OF THE INVENTION

The objective of the present invention is to provide a signal connector with combined structure.

Another objective of the present invention is to provide a signal connector with a guiding fillister and a through hole.

Still another objective of the present invention is to provide a signal connector with a connecting element and a positioning element.

In order to achieve the above-mentioned objective, the invention of the signal connector comprises a first container and a second container. The first container comprises a first signal line container which can contain a plurality of cores and comprises a first fastener which can fix the signal line. The second container comprises a second signal line container which can contain the plurality of cores and a plurality of electric contacts which can be electrically connected with each of the plurality of cores. The second container can be connected with the first container.

In order to achieve another objective of the invention, the first signal line container of the signal connector comprises a guiding fillister capable of guiding the plurality of cores. The second signal line container of the signal connector comprises a through hole. The plurality of cores can pass through the second signal line container by the through hole.

In order to achieve still another objective of the invention, the first signal line container and the second signal line container of the signal connector separately comprises a linking element which matches up with each other. The linking element can connect with the first container and the second container. The first signal line container and the second signal line container of the signal connector separately comprises a positioning element which matches up with each other. The positioning element can limit the position of the first container and the second container when contacting with each other.

Other objectives, advantages, and novel features of the invention will become more apparent from the following detailed description when taken in conjunction with the accompanying drawings.

DETAILED DESCRIPTION OF THE PREFERRED EMBODIMENT

Figure 1A:
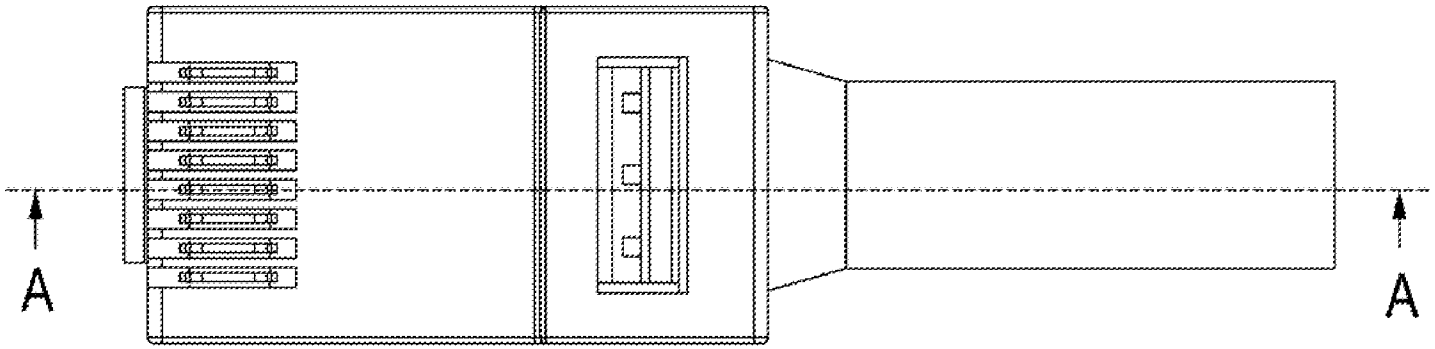
FIG. 1A is a state diagram for a prior signal connector when the signal line is not fixed.
Figure 1B:
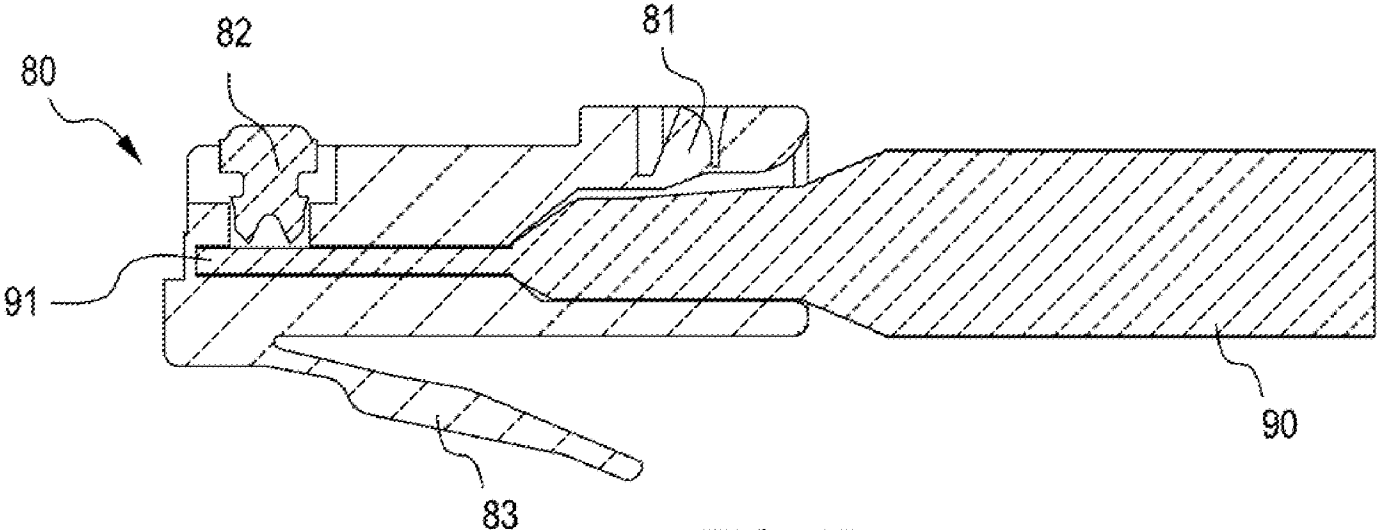
FIG. 1B is a cross-sectional diagram of FIG. 1A along A-A line.
Figure 2A:
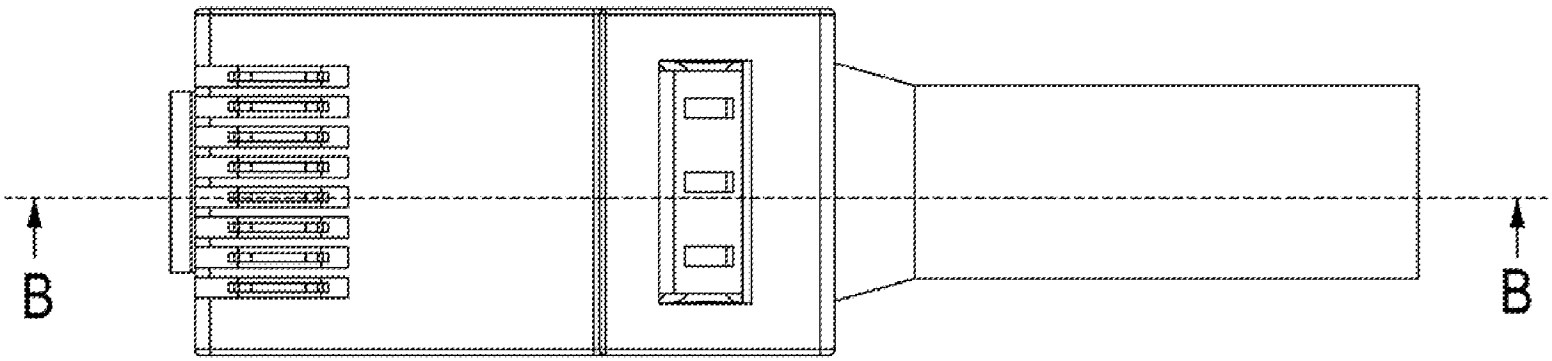
FIG. 2A is a state diagram for the prior signal connector when the signal line is fixed.
Figure 2B:
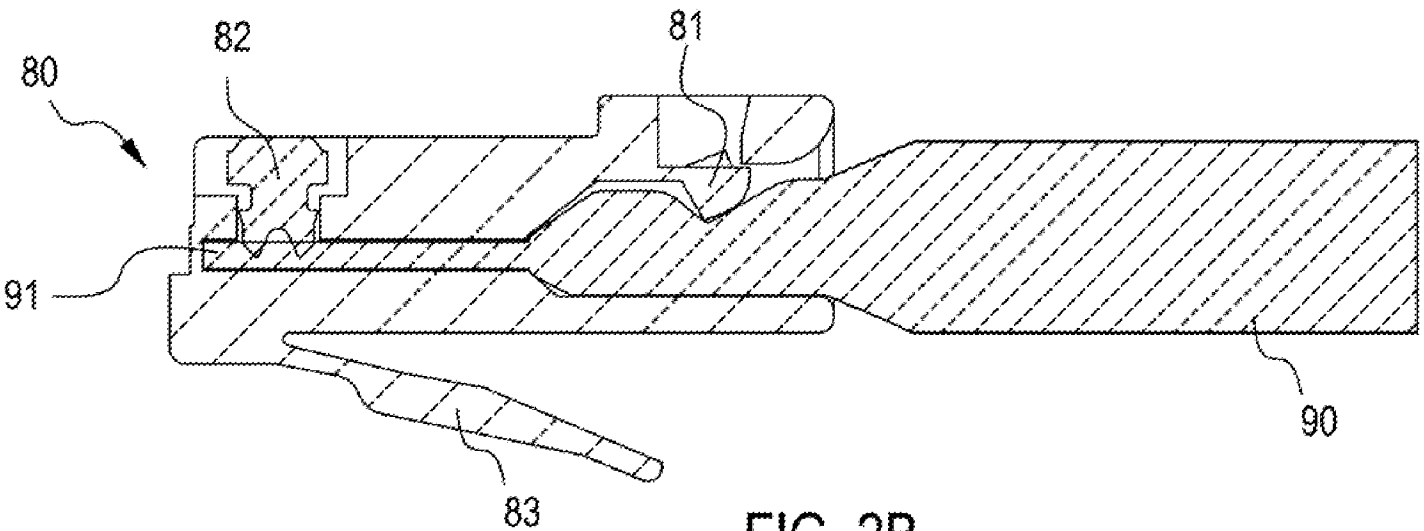
FIG. 2B is a cross-sectional diagram of FIG. 2A along B-B line.
Figure 3:
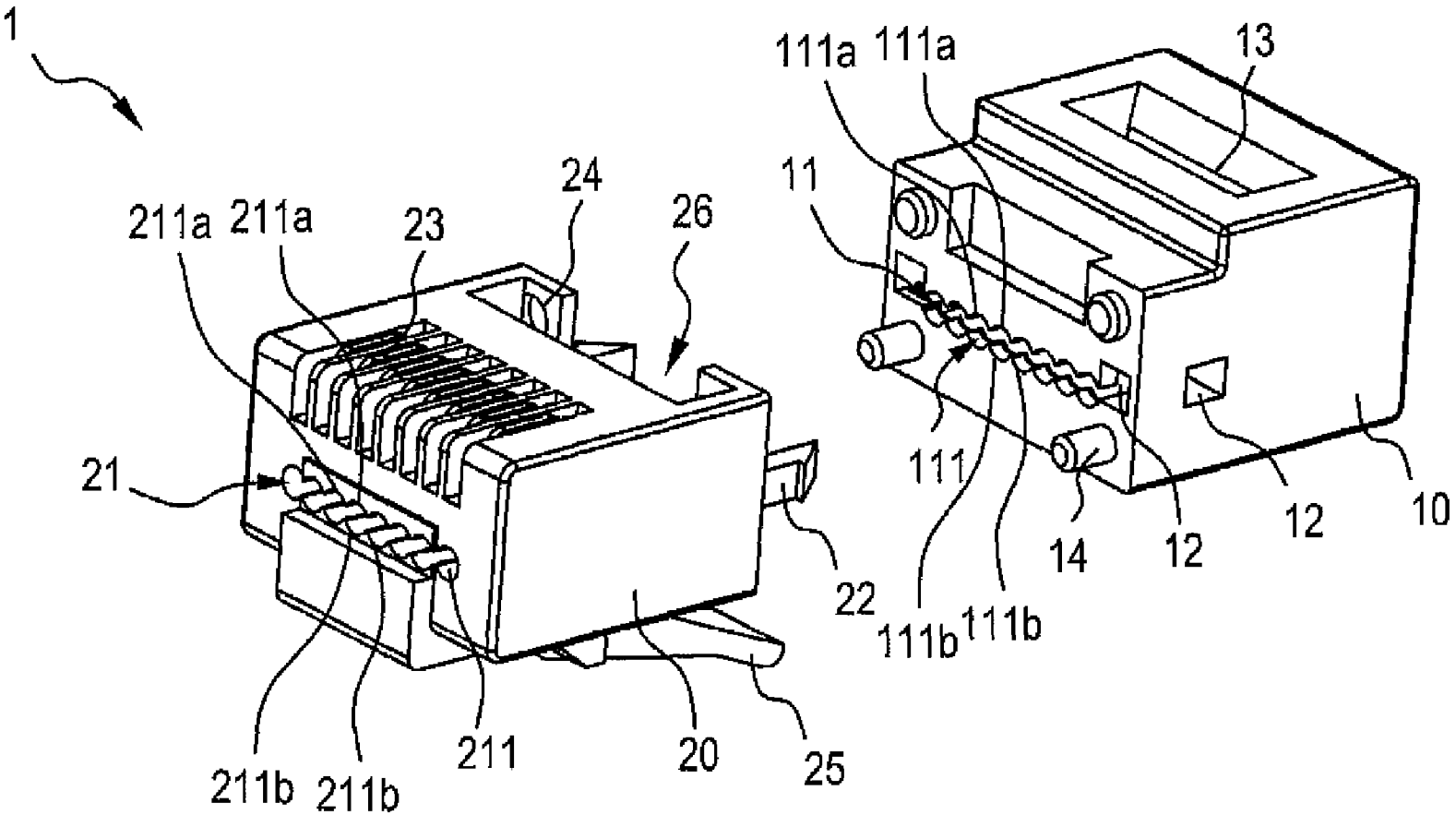
FIG. 3 is a perspective view of the embodiment of the invention.
Figure 4:
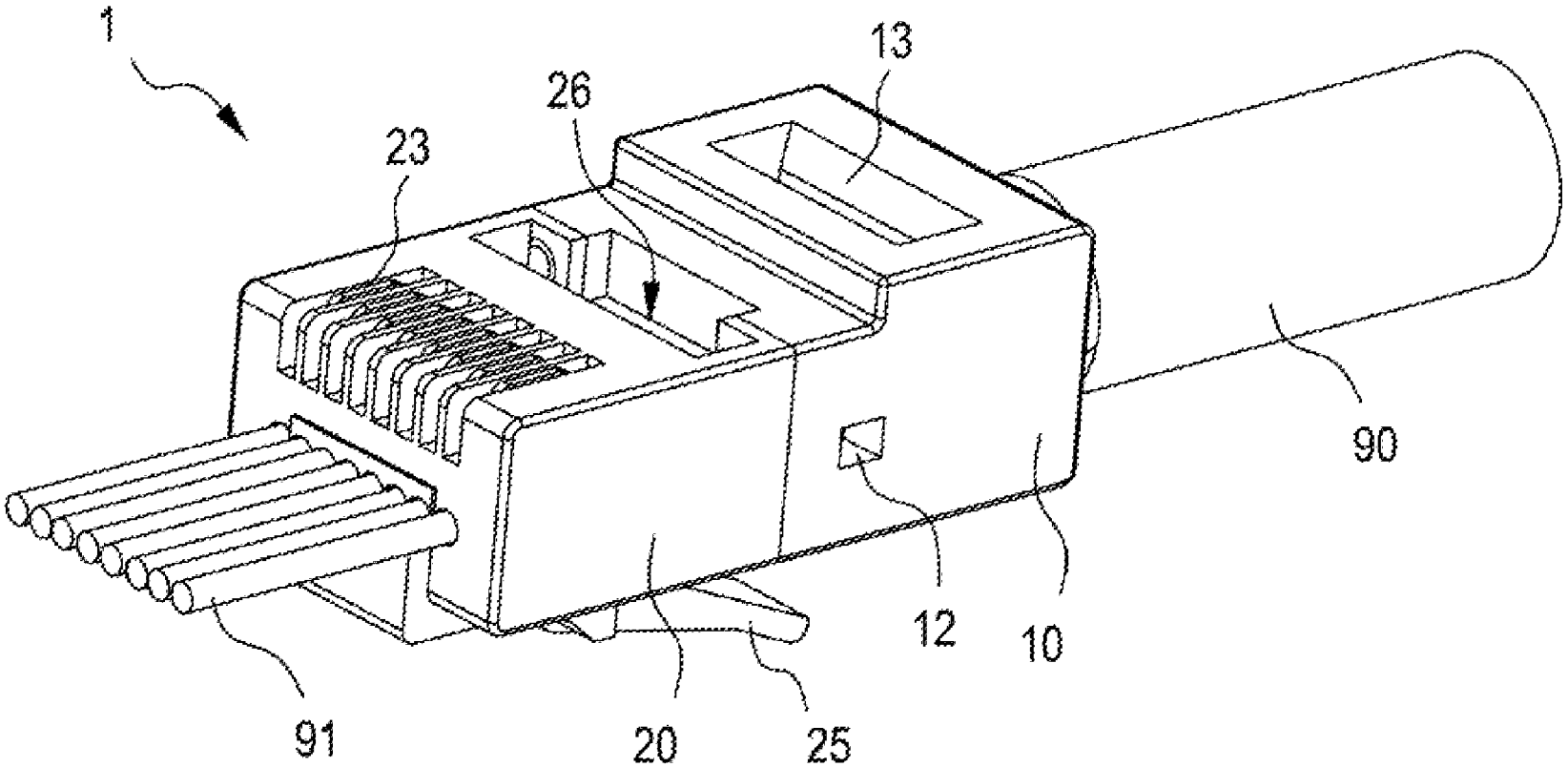
FIG. 4 is a perspective view of the embodiment of the invention in completing the processes.

Please refer to FIG. 3 and FIG. 4 to illustrate the structure and the combination of the invention. The invention of the signal connector 1 is provided to connect the signal line 90. The signal line 90 can be a network line or a telephone line. The signal line 90 comprises a plurality of cores 91. The signal connector 1 comprises a first container 10 and a second container 20.

The first container 10 comprises a first signal line container 11 which is provided to contain the plurality of cores 91, a first fastener 13, a first linking element 12, and a first positioning element 14. The first signal line container 11 comprises a guiding fillister 111. The shape of the guiding fillister 111 matches the outer shape of the plurality of cores 91 to provide each of the plurality of cores 91 with an individual containing space each having an upper curved portion 111*a* and a lower curved portion 111*b* . The plurality of cores 91 can be contained in the guiding fillister 111 in an orderly manner. In the embodiment, the signal line 90 comprises eight cores 91, so the guiding fluster 111 can be divided into eight individual containing spaces. It is important to take note that the signal line 90 is not limited to comprising eight cores 91, and also the guiding fillister 111 is not limited to comprising eight individual containing spaces. The only thing is that the number of the individual containing spaces of the guiding fillister 111 matches the number of the cores 91. For instance, the number of the individual containing spaces of the guiding fillister 111 can be equal to the number of the cores 91 or more than the number of the cores 91.

The second container 20 comprises a second signal line container 21 which is provided to contain the plurality of cores 91, a plurality of electric contacts 23, a second linking element 22, a second positioning element 24, a fixed part 25, and a second fastener 26. The second signal line container 21 comprises a through hole 211 so that the plurality of cores 91 can pass through the second container 20. The advantage of the through hole 211 is that the plurality of cores 91 can pass through the through hole 211, and, then, the cores 91 can be trimmed to the necessary length.

The purpose of the first fastener 13 is to fix the signal line 90. The first linking element 12 can match up with a second linking element 22 of the second container 20 to achieve the linking purpose. The first positioning element 14 can match up to the second positioning element 24 to achieve the positioning purpose.

The purpose of the second fastener 26 is to fix the signal line 90. It is important to note that the first fastener 13 and the second fastener 26 are not the necessary components of the invention. In other words, signal connector 1 can merely comprise the first fastener 13 and not comprise the second fastener 26 or can merely comprise the second fastener 26 and not comprise the first fastener 13.

In the embodiment, the signal line 90 comprises eight cores 91, so the through hole 211 can be divided into eight individual containing spaces each having an upper curved portion 211*a* and a lower curved portion 211*b*. It is important to take note that the signal line 90 is not limited to comprising eight cores 91, and also the through hole 211 is not limited to comprising eight individual containing spaces. The only thing is that the number of the individual containing spaces of the through hole 211 matches the number of the cores 91. For instance, the number of the individual containing spaces of the through hole 211 can be equal to the number of the cores 91 or more than the number of the cores 91.

It is also important to take note that the second signal line container 21 does not need to be a through hole. It can be a trough that doesn't pass through. In this situation, the plurality of cores 91 have to be cut into the same length before putting into the second signal line container 21.

Each of the electric contacts 23 can be electrically connected with each of the cores 91, and the cores 91 through the electric contacts 23 send the signal to an external socket ( not shown in the figure). The fixed part 25 of the second container 20 can be used to fix the signal connector 1 to an external socket.

The second linking element 22 is a fixed element which is matched up with the first linking element 12. The second container 20 can be connected with the first container 10 by the second linking element 22 and the first linking element 12. In the embodiment, the first linking element 12 is a notch, and the second linking element 22 is a hook. When the hook goes into the notch, the first linking element 12 and the second linking element 22 are connected with each other. It is important to note that only the first linking element 12 and the second linking element 22 being elements with linking function which match with each other should be the scope of the invention. For instance, the first linking element 12 can be a hook and the second linking element 22 can be a notch, or both the first Linking element 12 and the second linking element 22 are hooks which are matched with each other.

The second positioning element 24 is an element which matches up with the first positioning element 14. In the embodiment, the first positioning element 14 is in protruded shape, and the second positioning element 24 is in depressed shape. The first positioning element 14 can be put in the second positioning element 24 exactly to make the contact surface between the first container 10 and the second container 20 not relatively move. It is important to note that only the first positioning element 14 and the second positioning element 24 being elements with positioning function which match with each other should be the scope of the invention. For instance, the first positioning element 14 can be a depressed shape, and the second positioning element 24 can be a protruded shape.

Figure 5:
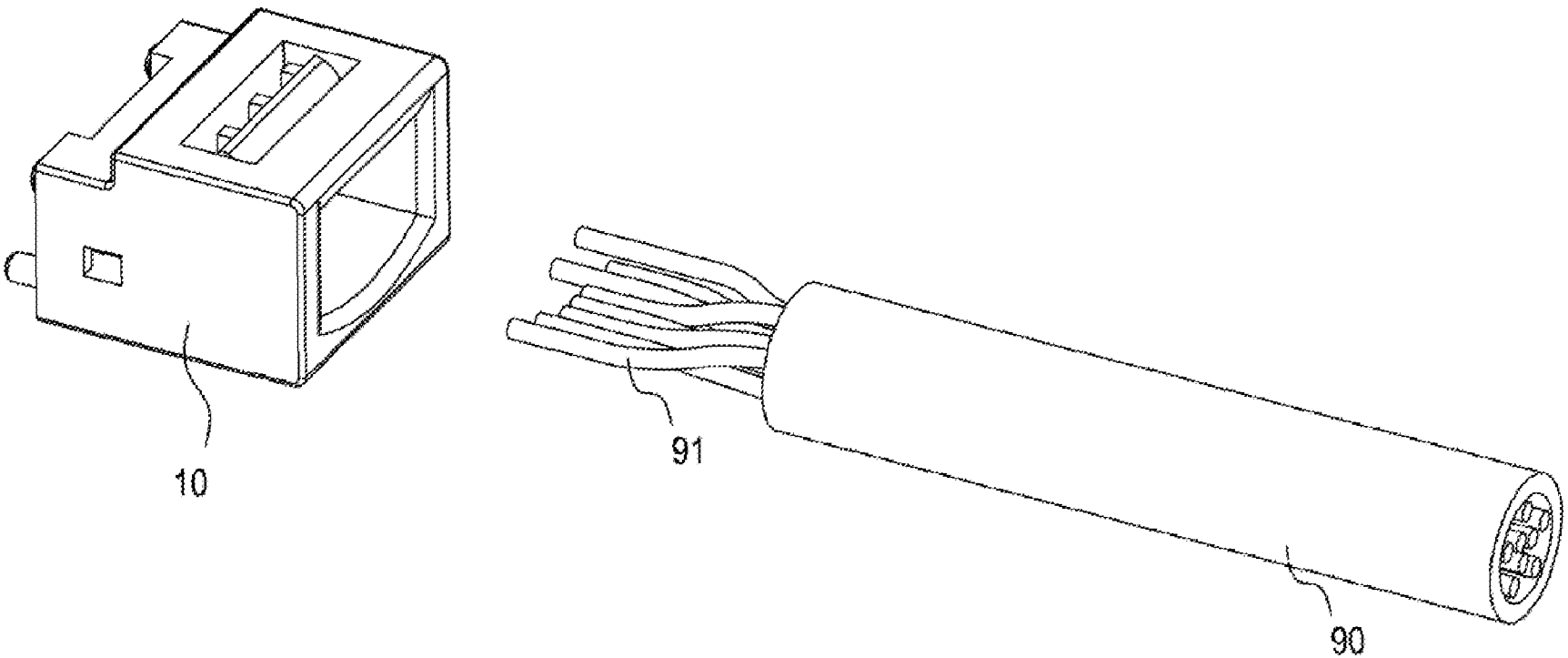
FIG. 5 is a perspective view when the signal line doesn't pass through the first container.
Figure 6:
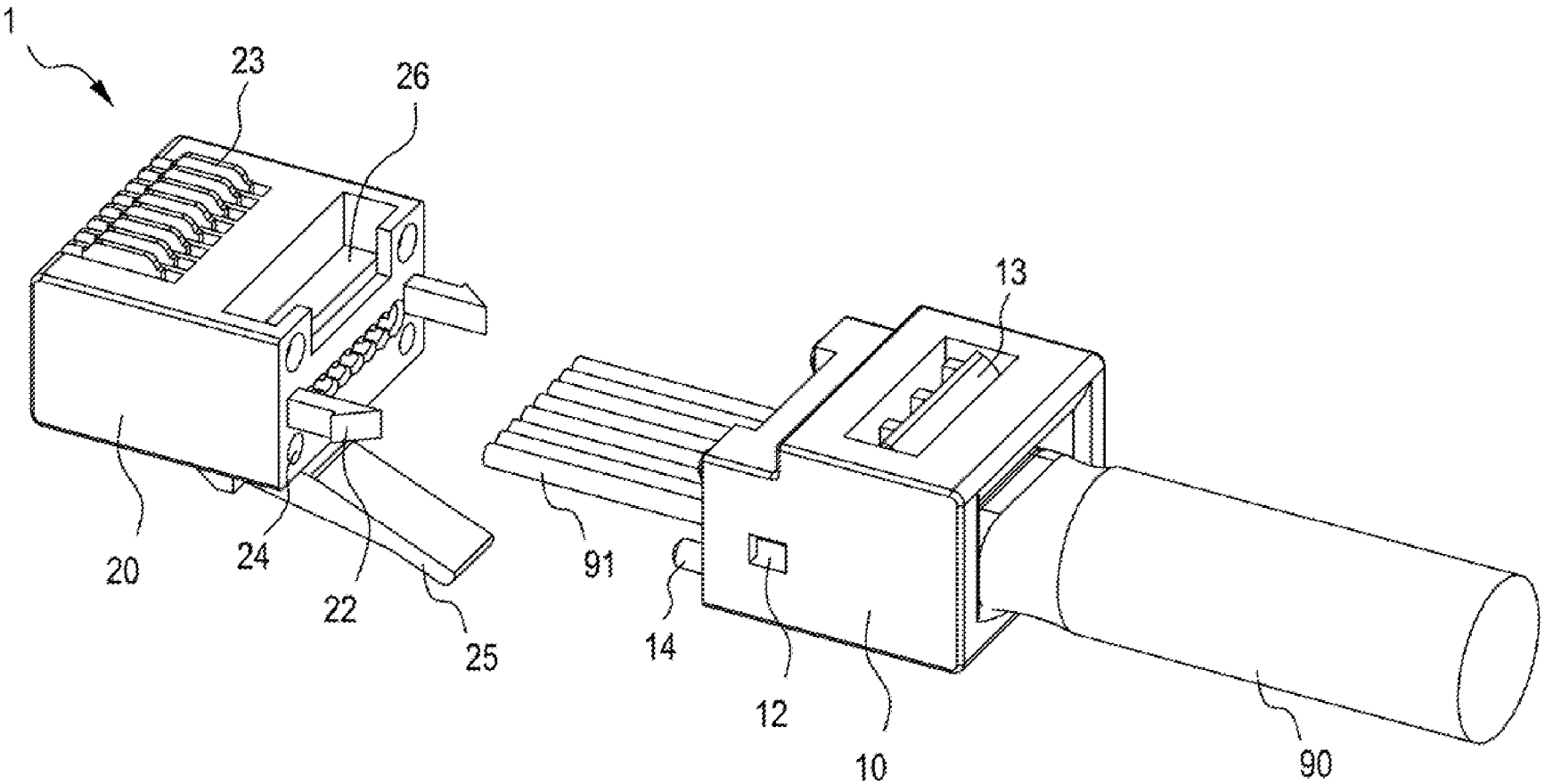
FIG. 6 is a perspective view when the signal line passes through the first container but doesn't pass through the second container.
Figure 7:
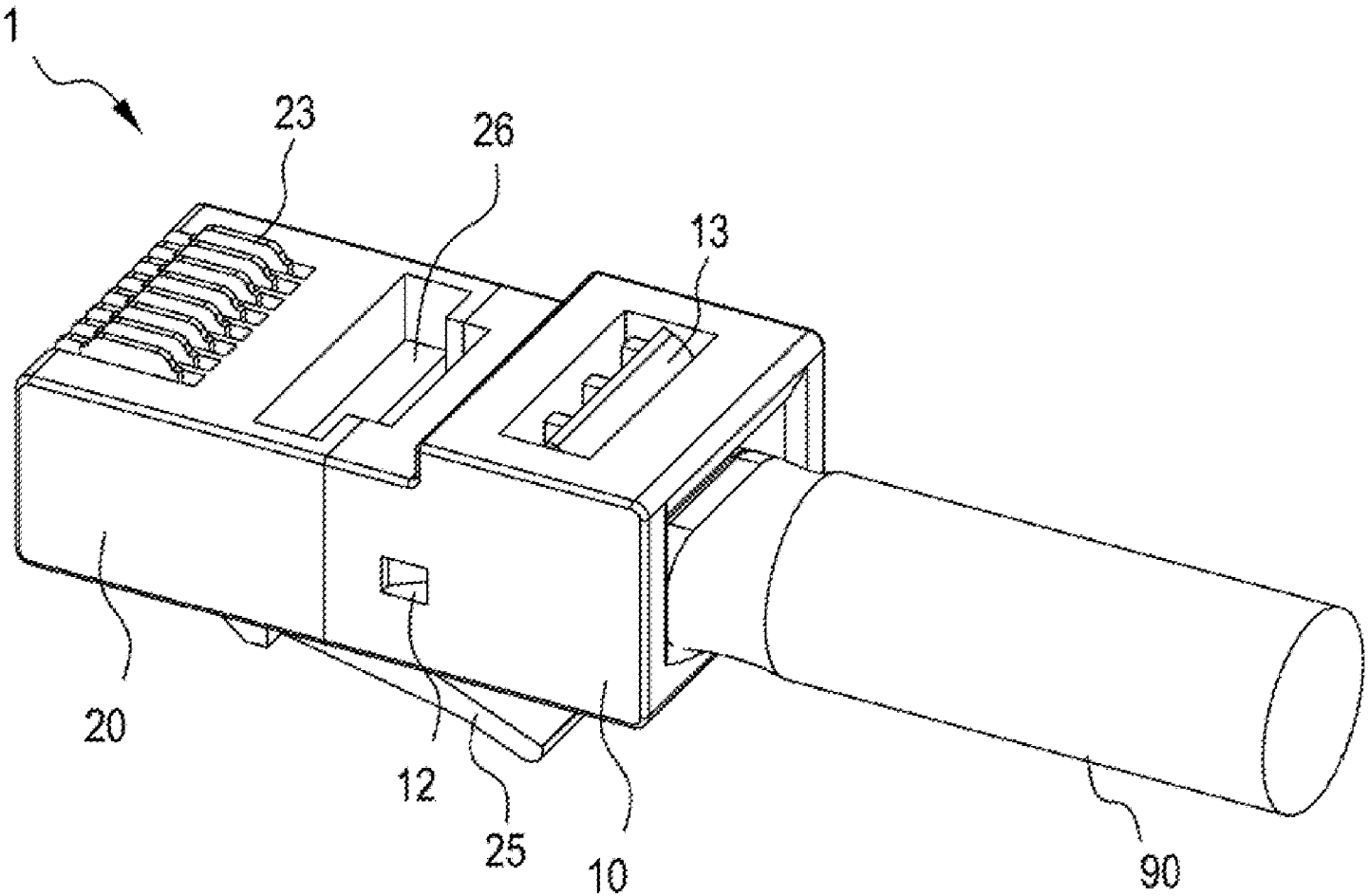
FIG. 7 is a perspective view when the first container and the second container are combined with each other.

Please refer to FIG. 5 to FIG. 7 simultaneously to illustrate the fabricating flow path of the signal connector 1 of the invention. Referring to FIG. 5, the plurality of cores 91 of signal line 90 has not passed through the first container 10 yet. The end of the plurality of cores 91 is not tidy, so the cores 91 are required to be arranged in order to put the cores 91 into the first container 10.

Then please refer to FIG. 6. Because the length of the first container 10 is shorter, the cores 91 can be put into the guiding fillister 111 (Please refer to FIG. 3 simultaneously) of the first container 10 easily. After the cores 91 are put into the first container 10, it becomes tidier. The first positioning element 14 of the first container 10 and the second positioning element 24 of the second container 20 are matched with each other to make the contact surface between the first container 10 and the second container 20 not relatively move to achieve the positioning purpose.

FIG. 7 is shown as completing the connecting and positioning process of the first container 10 and the second container 20. The first fastener 13 and the electric contacts 23 are not pressed in FIG. 7. The last step is to press the first fastener 13 and the electric contacts 23 by a hand tool (Refer to the first fastener 13 and the electric contacts 23 in FIG. 4) to complete the fabricating process.

Although the present invention has been explained in relation to its preferred embodiment, it is to be understood that many other possible modifications and variations can be made without departing from the spirit and scope of the invention as hereinafter claimed.

What is claimed is:

1. A signal connector for connecting a signal line which comprises a plurality of cores comprising:

a first container, wherein the first container comprises:

a first signal line container having a guiding fillister including a first individual containing space for each core of the plurality of cores, and with the first container further including a first fastener which can fix the signal line;

a second container connected with the first container and comprising:

a second signal line container having a through hole divided into a second individual containing space for each core of the plurality of cores, with the through hole allowing the plurality of cores to pass through the second signal line container, with the first and second individual container spaces being axially aligned when the first and second containers are connected, and a plurality of electric contacts intersecting with the second individual containing spaces of the through hole and spaced from the first individual containing spaces and electrically connected with each core of the plurality of cores.

2. The signal connector as claimed in claim 1, wherein each first individual containing space of the guiding fillister has an upper curved portion and a lower curved portion corresponding to and adapted to receive the core of the plurality of cores.

3. The signal connector as claimed in claim 1, wherein each second individual containing space of the through hole has an upper curved portion and a lower curved portion corresponding to and adapted to receive the core of the plurality of cores.

4. The signal connector as claimed in claim 1, wherein the first signal line container further comprises a first linking element, and the second signal line container further comprises a second linking element; wherein the first linking element matches the second linking element, and wherein the first container and the second container is linked by the first linking element and the second linking element.

5. The signal connector as claimed in claim 4, wherein the first linking element is a notch, and the second linking element is a hook.

6. The signal connector as claimed in claim 4, wherein the first linking element is a hook, and the second linking element is a notch.

7. The signal connector as claimed in claim 1, wherein the first signal line container comprises at least one first positioning element, and the second signal line container comprises at least one second positioning element; the first positioning element and the second positioning element are matched with each other, and wherein the first positioning element and the second positioning element limits the position of the first container and the second container when contacting with each other.

8. The signal connector as claimed in claim 7, wherein the first positioning element is a protruded shape, and the second positioning element is a depressed shape.

9. The signal connector as claimed in claim 7, wherein the first positioning element is a depressed shape, and the second positioning element is a protruded shape.

10. The signal connector as claimed in claim 1, wherein the second container further comprises a second fastener, and the second fastener fixing the signal line.

11. The signal connector as claimed in claim 1, wherein the second container further comprises a fixed part, and the fixed part fixes the signal connector in an external socket.

12. The signal connector as claimed in claim 1, wherein the plurality of cores is a network line or a telephone line.

13. A signal connector for connecting a signal line which comprises a plurality of cores comprising:

a first container; wherein the first container comprises a first signal line container having a guiding fillister including a first individual containing space for each core of the plurality of cores, and a second container connected with the first container and comprising:

a second signal line container having a through hole divided into a second individual containing space for each core of the plurality of cores, with the through hole allowing the plurality of cores to pass through the second signal line container, with the first and second individual container spaces being axially aligned when the first and second containers are connected, and a plurality of electric contacts intersecting with the second individual contain spaces of the through hole and spaced from the first individual containing spaces and electrically connected with each core of the plurality of cores.

14. The signal connector as claimed in claim 13, wherein the first container further comprises a first fastener, and the second container further comprises a second fastener; wherein the first fastener and the second fastener fixes the signal line.

15. The signal connector as claimed in claim 13, wherein each first individual contain space of the guiding fillister has an upper curved portion and a lower curved portion corresponding to and adapted to receive the core of the plurality of cores.

16. The signal connector as claimed in claim 13, wherein each second individual containing space of the through hole has an upper curved portion and a lower curved portion corresponding to and adapted to receive the core of the plurality of cores.

* * * * *